United States Patent [19]

Haüsler et al.

[11] 4,344,382

[45] Aug. 17, 1982

[54] APPARATUS FOR APPLYING ATOMIZED PLASTICIZER TO A RUNNING TOW OF FILAMENTARY FILTER MATERIAL

[75] Inventors: Nikolaus Haüsler, Oststeinbek; Adolf Helms, Hamburg, both of Fed. Rep. of Germany

[73] Assignee: Hauni-Werke Körber & Co. KG, Hamburg, Fed. Rep. of Germany

[21] Appl. No.: 254,521

[22] Filed: Apr. 15, 1981

[30] Foreign Application Priority Data

Apr. 17, 1980 [DE] Fed. Rep. of Germany ..... 3014807

[51] Int. Cl.[3] ..... B05B 13/02

[52] U.S. Cl. ..... 118/674; 118/325; 239/102

[58] Field of Search ..... 239/102; 118/325, 300, 118/674

[56] References Cited

U.S. PATENT DOCUMENTS

| | | | |
|---|---|---|---|
| 2,512,743 | 6/1950 | Hansell | 118/300 |
| 3,741,846 | 6/1973 | Greve | 118/325 X |
| 4,132,189 | 1/1979 | Greve et al. | 118/325 X |

*Primary Examiner*—Bernard D. Pianalto

*Attorney, Agent, or Firm*—Kontler, Grimes & Battersby

[57] ABSTRACT

A running tow of spread-out filamentary filter material in a filter rod making machine is sprayed with plasticizer by two ultrasonic atomizing devices which are disposed at the opposite sides of the path of the tow and each of which has a flexural resonator connected to one or more piezoelectric elements which, in turn, are connected to a source of a-c potential in order to expand and contract when the atomizing devices are in use. Each flexural resonator has an atomizing surface which extends transversely of the path for the tow, and the system which supplies plasticizer to such surfaces has pipes discharging plasticizer in the region of some or all oscillation nodes which develop when the atomizing devices are in use.

14 Claims, 4 Drawing Figures

117b'
117a'
118b'
118a'
118b
118a
117b
117a
102b
102a
102
101

113
F'
111
112
100
104
108a
108b
103
105
101
116
102
106
107
109
K
117a
117b
118a
IV
IV
114
118b
118b
118a
119
121
PUMP
122

123
123a
AMPLIFIER
127
126
124
THRESHOLD CIRCUIT
TACHOMETER GENERATOR

APPARATUS FOR APPLYING ATOMIZED PLASTICIZER TO A RUNNING TOW OF FILAMENTARY FILTER MATERIAL

BACKGROUND OF THE INVENTION

The present invention relates to liquid spraying apparatus in general, and more particularly to improvements in apparatus for atomizing one or more liquid streams and for applying the atomized liquid to a moving body, particularly to a running web or tow of filamentary material which is about to be converted into the filler of a filter rod. Still more particularly, the invention relates to improvements in apparatus which can be utilized with advantage for atomization of a plasticizer, such as triacetin, and for the application of atomized plasticizer to a tow consisting of acetate fibers or like filamentary material which is capable of intercepting substantial percentages of deleterious ingredients of tobacco smoke.

It is already known to equip a filter rod making machine with an apparatus which applies atomized plasticizer to a running web or tow of filamentary filter material. Such a machine normally comprises two sections or units, namely, a first or tow processing unit wherein a tow of filamentary filter material which is drawn from a bale is spread out to form a thin layer so that all or nearly all of the filaments are exposed for uniform application of an atomized plasticizer (particularly triacetin), and a second unit or section wherein the thus treated tow is converted into a rod-like filler and is draped into a web of cigarette paper or other suitable wrapping material to form therewith a continuous filter rod which is thereupon subdivided into filter rod sections of desired length. The means for applying atomized plasticizer to the spread-out tow in the first unit of such a machine includes one or more rotary brushes and means for supplying metered quantities of plasticizer to the brushes. The brushes convert one or more streams of like bodies of liquid plasticizer into fine droplets which are sprayed onto the running tow so that the plasticizer contacts all or nearly all filaments and enables the filaments to form a myriad of intricate paths for the flow of tobacco smoke toward the mouth of the smoker. The quality of filter plugs which are obtained from the aforementioned filter rod depends, to a considerable extent, on the degree of uniformity with which the filaments of the tow are contacted by atomized plasticizer. The degree of uniformity, in turn, depends on several factors such as proper spreading and tensioning of filaments which form the tow, the selected rate of delivery of plasticizer to the atomizing instrumentality or instrumentalities, and the nature of atomizing action.

In addition to brushes, it is also known to employ atomizing devices in the form of impeller wheels and nozzles. As of late, rotary brushes constitute the preferred atomizing devices because their bristles can readily break up a continuous stream or pool of liquid plasticizer into minute droplets. In most instances, the bristles of a rotating brush sweep along a surface which is coated with a film of liquid plasticizer whereby the bristles undergo deformation and thereupon recoil to propel minute droplets of plasticizer against the running filamentary filter material. A drawback of such atomizing apparatus is that the bristles of the brushes undergo rapid and often non-uniform wear so that the brushes must be inspected and replaced at frequent intervals. In the absence of replacement of a brush whose bristles have undergone pronounced wear, the bristles are likely to furnish a gradually deteriorating atomizing action so that the apparatus begins to propel large droplets of non-atomized plasticizer against the adjacent portions of the travelling tow. Apparatus which employ one or more brushes for atomization of plasticizer are disclosed, for example, in commonly owned U.S. Pat. Nos. 4,132,189 to Greve et al. and 3,974,007 to Greve.

OBJECTS AND SUMMARY OF THE INVENTION

An object of the invention is to provide a novel and improved apparatus which can be used for atomization of liquids, such as a plasticizer which is to be sprayed onto a tow of filamentary filter material, and which is constructed and assembled in such a way that it can furnish an unchanging atomizing action for practically unlimited periods of time.

Another object of the invention is to provide an atomizing apparatus which can be installed in existing filter rod making or analogous machines as a superior substitute for heretofore known atomizing apparatus.

A further object of the invention is to provide an atomizing apparatus which need not employ rotary or analogous parts and wherein the wear upon its component parts is nil or practically nil, especially when compared with the wear upon the rotary parts of heretofore known atomizing apparatus.

An additional object of the invention is to provide the atomizing apparatus with novel and improved means for reliably converting one or more streams of a liquid into finely comminuted particles and for directing the particles in a desired direction.

Still another object of the invention is to provide the atomizing apparatus with novel and improved means for varying the atomizing action in dependency on requirements of the material which is to be contacted with atomized liquid.

A further object of the invention is to provide an atomizing apparatus which need not employ brushes, paddle wheels, impellers or analogous rotary atomizing elements.

An additional object of the invention is to provide the atomizing apparatus with novel and improved means for carrying out the atomizing action in a small area, with relatively low energy consumption and with a degree of accuracy and reproducibility which cannot be matched by conventional apparatus.

The invention is embodied in an apparatus for applying liquid plasticizer to a running tow or web of filamentary filter material, particularly in a filter rod making machine. The apparatus comprises means for transporting the tow of filamentary material along a predetermined path, a source of liquid plasticizer, an ultrasonic atomizing device which is adjacent to the path of movement of the tow and is operable to spray atomized plasticizer onto successive increments of filamentary material in the path, and means (e.g., including one or more gear pumps or other suitable liqiud feeding means) for supplying or conveying plasticizer from the source to the atomizing device.

The apparatus preferably further comprises or cooperates with suitable banding means (e.g., one or more banding devices of the type having nozzles for directing currents of air against the tow) for spreading the tow in or ahead of the path so that the tow forms a relatively thin layer of exposed filamentary material during transport of filamentary material past the atomizing device.

The supplying or conveying means preferably comprises means for delivering to the atomizing device metered quantities of plasticizer. For example, the transporting means may comprise means for advancing the tow at a plurality of speeds (depending on the requirements of the aforementioned second unit in the filter rod making machine). The delivering means then comprises or may comprise means for varying the rate of delivery of plasticizer to the atomizing device as a function of changes in the speed of movement of the tow along its path.

In accordance with one of the presently preferred embodiments of the invention, the atomizing device comprises a flexural resonator, piezoceramic means which is connected with the flexural resonator, and a source of a-c potential which is connected with the piezoceramic means to effect expansion and contraction of the latter and corresponding movements of the flexural resonator. The flexural resonator can be provided with a substantially rectangular atomizing surface which extends along the full width of the path for the tow and receives liquid plasticizer from the conveying or supplying means. The supplying means preferably comprises means for delivering liquid plasticizer to several portions of the atomizing surface of the flexural resonator, i.e., along the full width of the spread-out filamentary material which is caused to advance along the path and past the atomizing device.

Highly satisfactory results can be achieved by resorting to two ultrasonic atomizing devices and by transporting the tow between the flexural resonators of the two atomizing devices. This renders it possible to spray atomized particles or droplets of plasticizer against both sides of the running tow.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
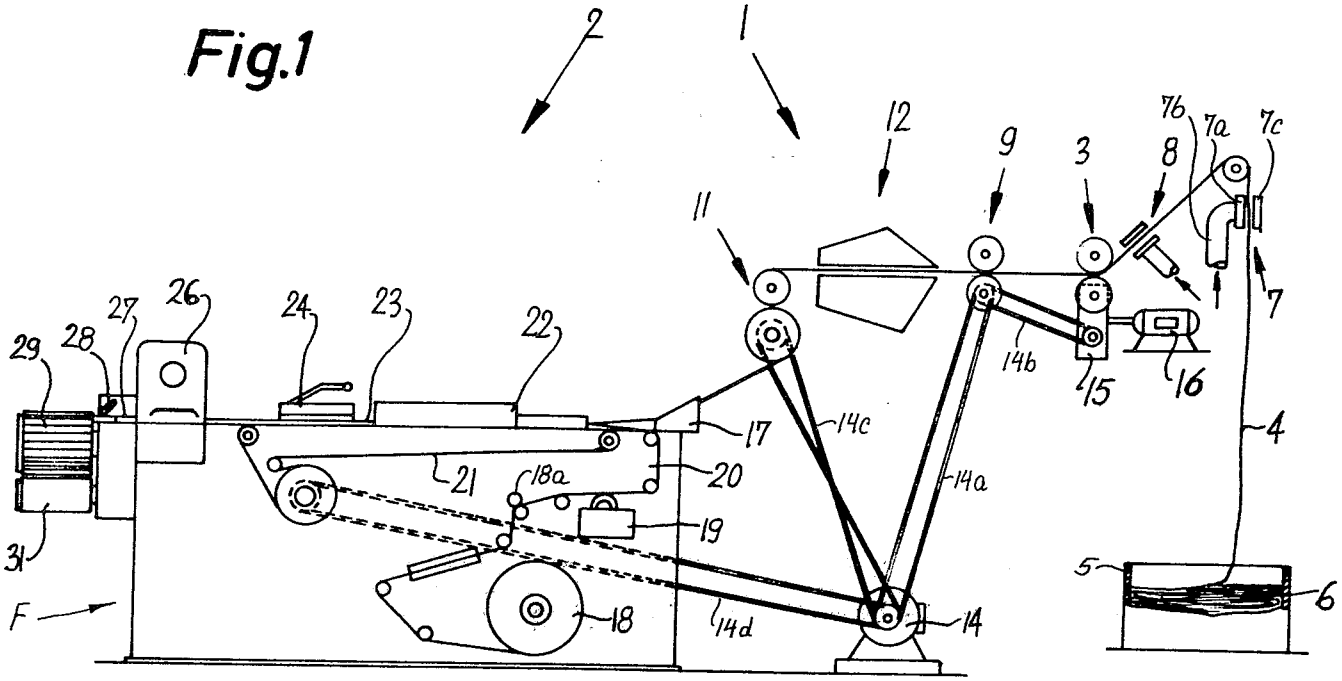
FIG. 1 is a schematic elevational view of a filter rod making machine with an atomizing apparatus which embodies one form of the invention.

Referring first to FIG. 1, there is shown a filter rod making machine which comprises two main sections or units 1 and 2. The section or unit 1 serves to process a tow 4 of filamentary filter material (for example, acetate fibers), and the section or unit 2 serves to convert the processed tow and a web 20 of suitable wrapping material into a continuous filter rod 23 which is thereupon subdivided to yield a file of discrete filter rod sections 27 of desired length.

The tow 4 is stored in the form of a bale 6 which is confined in a container 5. The means for withdrawing the tow 4 from the container 5 and for transporting the tow along a predetermined path toward the section or unit 2 includes a pair of advancing rolls 3 which are located downstream of two banding devices 7 and 8 each of which serves to spread the tow 4 in a direction at right angles to the plane of FIG. 1 so that the tow is converted into a relatively wide and thin layer of neighboring filaments which are exposed preparatory to the application of atomized liquid plasticizer thereto. Each of the banding devices 7 and 8 preferably comprises a composite nozzle (see the nozzle *7a*) which receives compressed air or another gaseous fluid by way of a conduit (see the conduit *7b*). The orifices of the nozzle discharge streamlets of compressed gaseous fluid which penetrates through the running tow 4 and separates the neighboring filaments from each other. The streamlets of gaseous fluid rebound on a plate (see the plate *7c* of the banding device 7). The rolls 3 are followed by two additional pairs of advancing or transporting rolls 9 and 11 which are respectively located behind and ahead of an atomizing station for an atomizing apparatus 12 which is constructed and operates in accordance with one embodiment of the present invention.

The means for driving the advancing rolls 3, 9 and 11 comprises a main prime mover 14 (e.g., a variable-speed electric motor) the output element of which drives several belt or chain transmissions. The transmission 14*a* drives the lower roll 9 which, in turn, transmits motion to the input element of a variable-speed transmission 15 by way of a further belt or chain transmission 14*b*. The output element of the transmission 15 drives the lower roll 3. The ratio of the transmission 15 can be changed by a servomotor 16 which can be adjusted by hand or by remote control. The purpose of the transmission 15 is to change the ratio of the speed of advancing rolls 3 relative to the speed of advancing rolls 9 so that the tow 4 which advances from the nip of the rolls 3 toward the nip of the rolls 9 can be subjected to a desirable stretching or elongating action. Such stretching action ensures that the crimp of filamentary material of the tow 4 is reduced or disappears before the corresponding increment of increments of the tow reach the atomizing station between the advancing rolls 9 and 11.

A further belt or chain transmission 14*c* transmits torque from the output element of the main prime mover 14 to the lower roll 11. Still another belt or chain transmission 14*d* transmits motion from the main prime mover 14 to the moving parts of the second unit or section 2 of the filter rod making machine shown in FIG. 1.

The advancing rolls 9 and 11 are preferably designed in such a way that one roll of each pair is provided with circumferential grooves whereas the other or complementary roll has a smooth peripheral surface which is provided on an elastic portion of the respective roll. For example, the lower rolls 9 and 11 can have grooves in their peripheral surfaces whereas the upper rolls 9 and 11 comprise sleeve-like cylindrical peripheral portions of elastomeric material.

If the filamentary material of the tow 4 exhibits a pronounced crimp, the speed of the rolls 9 will considerably exceed the speed of the rolls 3 so that the filaments of the tow are subjected to a stretching or elongating action during travel toward the nip of the rolls 9. Such stretching or elongating action can remain unchanged or changes relatively little while the filaments travel from the nip of the rolls 9 toward and beyond the nip of the rolls 11.

The atomizing apparatus 12 sprinkles minute droplets of liquid plasticizer (for example, triacetin) onto the spread-out tow 4 in the region between the pairs of advancing rolls 9 and 11. The thus treated tow 4 is caused to pass through the nip of the rolls 11 and enters a gathering horn 17 of the second section or unit 2. The purpose of the horn 17 is to convert the freshly treated tow 4 into a rod-like filler which is delivered onto the upper reach of an endless belt conveyor 21, known as garniture, which also transports the aforementioned web 20 of wrapping material. Such material is withdrawn from a bobbin 18 by advancing rolls 18*a* and one of its sides is coated with a suitable adhesive during travel along a paster 19 mounted in or on the frame F of the section 2. The upper reach of the garniture 21 transports the web 20 and the rod-like filler through a wrapping mechanism 22 which drapes the web 20 around the filler so that the web is converted into a tubular wrapper which surrounds the filler and forms therewith the aforementioned continuous filter rod 23. The wrapper has a longitudinally extending seam which is heated or cooled (depending on the nature of adhesive supplied by the paster 19) by a sealer 24 located downstream of the wrapping mechanism 22. Succesisve increments of the rod 23 are severed at regular intervals by a cutoff 26 so that the rod 23 yields a single file of discrete filter rod sections 27 of desired length. Successive filter rod sections 27 are accelerated by the lobes of a rapidly rotating cam 28 which propels the filter rod sections into successive peripheral flutes of a rotary drum-shaped row forming conveyor 29. The conveyor 29 converts the single file of filter rod sections 27 into one or more rows wherein the filter rod sections travel sideways, i.e., along the circumference of the conveyor 29, and are deposited onto the upper reach of a belt conveyor 31 serving to transport filter rod sections into storage, into the magazine of a filter tipping machine, or to another destination.

Figure 2:
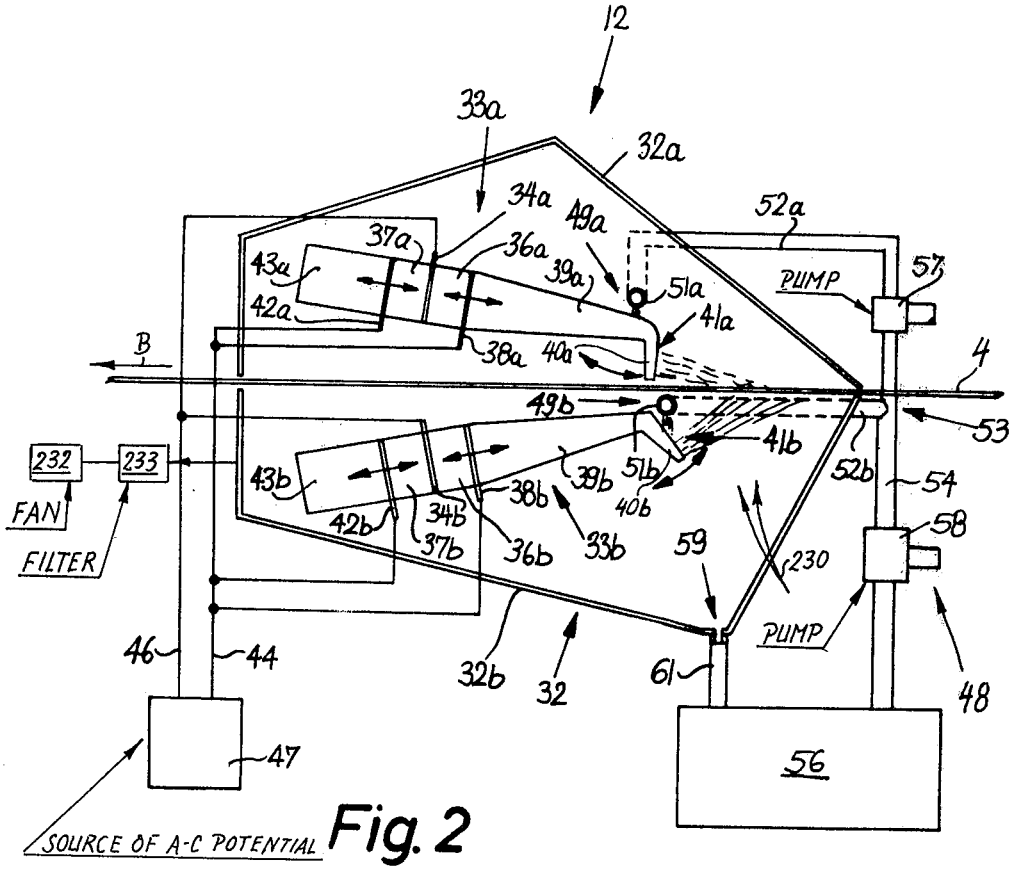
FIG. 2 is an enlarged schematic longitudinal vertical sectional view of the atomizing apparatus in the filter rod making machine of FIG. 1.

The details of the atomizing apparatus 12 are shown in FIG. 2. This apparatus comprises a housing or casing 32 including an upper half or section 32*a* and a lower half or section 32*b*. The two sections or halves 32*a* and 32*b* define a substantially horizontal gap for the passage of successive increments of the spread-out tow 4 through the interior of the housing 32.

In accordance with the invention, each of the sections 32*a* and 32*b* confines an ultrasonic atomizing device. The upper ultrasonic atomizing device is denoted by the reference character 33*a*, and the character 33*b* denotes the lower ultrasonic atomizing device in the section or half 32*b* of the housing 32. The upper atomizing device 33*a* comprises two piezoceramic elements 36*a* and 37*a* which are coupled to each other with the interposition of an electrode 34*a* therebetween. The electrode 34*a* is connected to one terminal of a source 47 of a a-c potential by conductor means 46. The piezoceramic element 37*a* is disposed between the electrode 34*a* and a further electrode 42*a* which is connected to another terminal of the source 47 by conductor means 44. The electrode 42*a* is placed between the piezoceramic element 37*a* and a metallic complementary resonator or counterresonator 43*a*. A third electrode 38*a*, which is also connected to conductor means 44, is disposed between the piezoceramic element 36*a* and an amplitude transformer 39*a*. The piezoceramic elements 36*a* and 37*a* can be replaced with piezo crystals. The amplitude transformer 39*a* can consist of refined steel or titanium. The downwardly bent free end portion or tip of the amplitude transformer 39*a* constitutes a flexural resonator 40*a*. The purpose of the resonator 40*a* is to convert the supplied stream or streams of liquid atomizer into minute droplets which are propelled onto the adjacent filaments of the tow 4 in the path defined by the housing sections 32*a* and 32*b*. The flexual resonator 40*a* has an elongated rectangular atomizing surface 41*a* which extends at right angles to the plane of FIG. 2, namely, along the full width of the path for the expanded filamentary material of the tow 4.

The atomizing device 33*b* in the lower housing section 32*b* is similar to the atomizing device 33*a*. It comprises a metallic complementary resonator or counterresonator 43*b* which is connected with the piezoceramic element 37*b* by an electrode 42*b* connected to the conductor means 44. The piezoceramic elements 36*b* and 37*b* of the atomizing device 33*b* are separated from each other by an electrode 34*b* which is connected to conductor means 46. A further electrode 38*b*, which is connected to the conductor means 44, is disposed between the piezoceramic element 36*b* and the amplitude transformer 39*b* which includes a flexural resonator 40*b* having an elongaged rectangular atomizing surface 41*b* which extends substantially at right angles to the plane of FIG. 2 and along the full width of the spread-out tow 4 between the housing sections 32*a* and 32*b*.

The amplitudes of the transformers 39*a* and 39*b* are attuned to the respective complementary resonators 43*a* and 43*b* in such a way that the piezoceramic elements 36*a* and 37*a*, as well as the piezoceramic elements 36*b* and 37*b*, are located at the oscillation nodes of the corresponding atomizing devices 33*a* and 33*b*. The connections between the atomizing devices 33*a* and 33*b* on the one hand, and the housing sections 32*a* and 32*b* on the other hand, are also disposed in the regions of oscillation nodes of the corresponding atomizing devices.

The means 48 for feeding plasticizer to the flexural resonators 40*a* and 40*b* of the corresponding amplitude transformers 39*a* and 39*b* comprises a source 56 of liquid plasticizer, a main supply conduit 54 which contains a pump 58 for delivery of metered quantities of liquid plasticizer from the source 56 into a pair of conduits 52*a* and 52*b* which branch off the conduit 54 and the free end portions of which comprise manifolds 51*a*, 51*b* with orifices for discharge of streamlets of liquid plasticizer onto the adjacent portions of amplitude transformers 39*a* and 39*b*. The reference character 49*a* denotes the location where the manifold 51*a* discharges liquid plasticizer onto the transformer 39*a*. Such plasticizer flows toward and is atomized at the surface 41*a* of the respective flexural resonator 40*a*. The locus of application of plasticizer to the surface 41*b* of the flexural resonator 40*b* is shown at 49*b*. As mentioned before, the manifolds 51*a* and 51*b* (such manifolds may constitute elongated pipes with one or more rows of holes therein) extend along the full length of the respective atomizing surfaces, i.e., along the full width of the spread-out tow 4 of filamentary material in the gap between the housing sections 32*a* and 32*b*.

The reference character 53 denotes the junction between the branch conduits 52*a*, 52*b* on the one hand and the discharge end of the main supply conduit 54 on the other hand. The metering pump 58 in the main conduit 54 is driven by the prime mover 14 of the filter rod making machine shown in FIG. 1. A second metering pump 57 is installed in the branch conduit 52*a* downstream of the junction 53 and is also driven by the prime mover 14. The pump 58 determines the total quantity of liquid plasticizer which is withdrawn from the source 56 of the feeding means 48 at a rate determined by momentary speed of the prime mover 14. The purpose of the pump 57 is to control the ratio of the two liquid streams which respectively flow from the main conduit 54 into the branch conduits 52*a* and 52*b*. Thus, depending on setting of the pump 57, the conduit 52*a* can deliver to the manifold 51*a* more or less plasticizer than the amount which is delivered to the manifold 51*b* for distribution on the atomizing surface 41*b* of the flexural resonator 40*b* in the lower housing section 32*b*. Each of the pumps 57 and 58 is adjustable in addition to the fact that it delivers liquid plasticizer at a rate which varies as a function of changes in the speed of the prime mover 14 shown in FIG. 1.

The walls of the lower housing section 32*b* slope downwardly toward an outlet 59 which is disposed at the deepmost point of the housing section 32*b* and accumulates liquid plasticizer which was not accepted by the running tow 4. The thus gathered surplus of plasticizer is returned to the source 56 by a conduit 61.

When the atomizing apparatus 12 of FIG. 2 is in use, the conduits 52*a* and 52*b* deliver metered quantities of liquid plasticizer to the manifolds 51*a* and 51*b* which, in turn, supply streamlets of liquid plasticizer to the atomizing surfaces 41*a* and 41*b*. Owing to rapid recurrent movements of the flexural resonators 40*a* and 40*b*, the plasticizer which flows along the surfaces 41*a* and 41*b* is converted into minute droplets and such droplets are propelled onto the respective sides of the running tow 4. Any droplets which are not intercepted and retained by the filaments of the tow 4 are propelled against the nearest wall or walls of the housing 32 and flow toward and into the outlet 59 to be returned into the source 56 by way of the conduit 61.

The spraying of atomized plasticizer by the lower atomizing device 33*b* against the underside of the running tow 4 can be assisted by one or more jets or currents of compressed air flowing in the direction of propulsion of droplets by the flexural resonator 40*b* against the tow 4. If such operation is desired or necessary, i.e., if at least the atomizing and propelling action of the lower ultrasonic atomizing device 33*b* is to be assisted by currents of air, the atomizing devices 33*a* and 33*b* are preferably staggered with reference to each other, as considered in the direction (see the arrow B) of lengthwise movement of the tow 4. It will be noted that the flexural resonator 40*b* is located behind the flexural resonator 40*a*. This is desirable in order to ensure that the droplets of finely atomized plasticizer formed by the upper flexural resonator 40*a* and penetrating through the tow 4 cannot interfere with the travel of droplets from the surface 41*b* of the lower flexural resonator 40*b* against the underside of the tow 4. If the housing 32 contains means for receiving compressed air or another gas to assist the application of atomized plasticizer against the underside of the tow 4, the housing must also be provided with suitable means for extracting the admitted gaseous fluid from the interior of the housing. The arrows 230 denote the direction of admission of a compressed gaseous fluid into the housing 31, and the arrow 231 denotes the direction in which spent gaseous fluid is withdrawn from the housing. The reference character 232 denotes a suction fan which serves as an exhaust and draws spent gaseous fluid through a filter 233 in the conduit 231.

The principle on which the operation of ultrasonic atomizers 33*a* and 33*b* is based is well known and need not be described in detail here. The piezoceramic elements 36*a*, 37*a*, 36*b* and 37*b* expand and contract when the circuits of the respective sets of electrodes are completed, and the oscillatory movements of the counter-resonators 43*a*, and 43*b* enhance the movements of the flexural resonators 40*a*, 40*b* to achieve a highly satisfactory atomizing action.

An important advantage of the apparatus 12 is that its ultrasonic atomizing devices 33*a* and 33*b* require a minimum of maintenance and can produce a highly satisfactory atomizing action for long periods of time. The illustrated atomizing devices 33*a* and 33*b* constitute but one form of ultrasonic atomizing means which can be used in the apparatus of FIG. 2. As mentioned before, the piezoceramic elements 36*a*, 36*b*, 37*a* and 37*b* can be replaced with piezo crystals without departing from the spirit of the invention. Also, each of the housing sections 32*a*, 32*b* can accommodate two or even more atomizing devices. The illustrated devices 33*a* and 33*b* exhibit the advantage that a single atomizing surface (41*a* or 41*b* ) suffices to ensure satisfactory distribution of finely atomized plasticizer along the full width of the respective side of the running tow 4. The uniformity of distributing action of the rectangular surfaces 41*a* and 41*b* is enhanced by the provision of manifolds 51*a* and 51*b* which extend across the entire path of the tow 4.

Figures 3, 4:
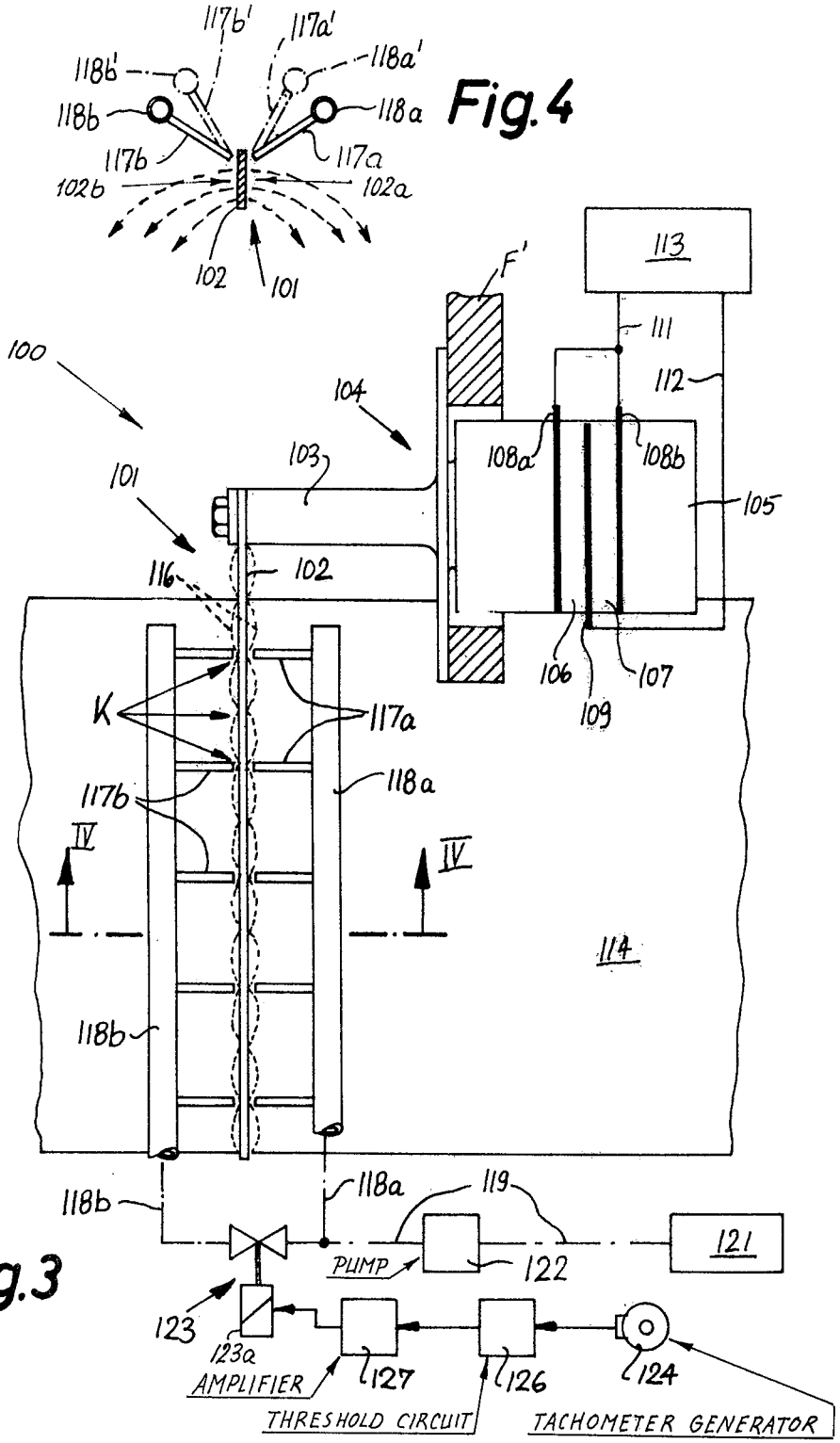
FIG. 3 is a schematic fragmentary partly plan and partly sectional view of a modified atomizing apparatus.
FIG. 4 is a fragmentary vertical sectional view as seen in the direction of arrows from the line IV—IV of FIG. 3.

FIGS. 3 and 4 illustrate a modified atomizing apparatus 100 which can be utilized in the machine of FIG. 1 as a substitute for the atomizing apparatus 12 of FIG. 2. The apparatus of FIGS. 3 and 4 comprises at least one ultrasonic atomizing device 101 which is disposed at one side of the running spread-out tow 114 of filamentary filter material. It is clear that the apparatus 100 of FIGS. 3 and 4 can comprise a second atomizing device which can be a mirror image of the device 101 and is disposed at the other side of the tow 114.

The atomizing device 101 comprises a narrow elongated strip-shaped flexural resonator 102 which has two elongated rectangular atomizing surfaces 102*a* and 102*b*. The length of the resonator 102 equals or exceeds the width of the tow 114. The tow 114 is assumed to travel in a vertical plane and the resonator 102 of the atomizing device 101 is vertical or nearly vertical. This resonator is a functional equivalent of the flexural resonator 39*a* or 39*b* shown in FIG. 2. One side of the upper portion of the resonator 102 is attached to an amplitude transformer 103 forming part of a longitudinal oscillator 104. The oscillator 104 is secured to a wall member F′ of the machine frame F and comprises a complementary resonator 105, two piezoceramic elements 106, 107 and three electrodes 108*a* (between the transformer 103 and the piezoceramic element 106), 109 (between the piezoceramic elements 106, 107) and 108*b* (between the piezoceramic element 107 and complementary resonator 105). The electrodes 108*a*, 108*b* are connected with a source 113 of a-c potential by conductor means 111. The conductor means 112 connects the median electrode 109 with the source 113. The resonator 102 and the longitudinal oscillator 104 preferably consist of titanium.

The surfaces 102*a* and 102*b* of the resonator 102 are preferably of rectangular outline and extend transversely of the path of the travelling tow 114. When the atomizing apparatus 100 of FIGS. 3 and 4 is in use, the resonator 102 is caused to oscillate at a frequency which is slightly above the acoustic limit, for example, at a frequency of 21 khz. The broken lines 116 denote in FIG. 3 the oscillations of the resonator 102. Such oscillations are greatly exaggerated for the sake of clarity. The reference character K denotes the nodes of oscillation of the resonator 102. The means for feeding liquid plasticizer to the atomizing surfaces 102*a* and 102*b* of the resonator 102 comprises two conduits 118*a*, 118*b* which are disposed at the opposite sides of the resonator 102 and admit liquid plasticizer into smaller conduits or pipes 117*a*, 117*b*. The discharge ends of the pipes 117*a* and 117*b* are adjacent to the oscillation nodes K of the resonator 102. The arrangement is preferably such that the spacing between neighboring conduits or pipes 117*a* or 117*b* equals or approximates twice the distance between a pair of neighboring nodes K, as considered in the longitudinal direction of the resonator 102. The conduits 118*a* and 118*b* branch off a main supply conduit 119 which recieves liquid plasticizer from a source 121 and contains a metering pump 122 driven by the main prime mover of the filter rod making machine.

The conduit 118*b* contains a shutoff valve 123, preferably a solenoid-operated valve which can be closed in response to a signal from a tachometer generator 124 driven at the speed of the main prime mover of the filter rod making machine. The connection between the solenoid 123*a* of the valve 123 and the tachometer generator 124 contains a threshold circuit 126 and an amplifier 127. The arrangement is such that the signal from the tachometer generator 124 causes the valve 123 to open when the speed of the main prime mover (corresponding to the motor M shown in FIG. 1) exceeds a preselected value which is determined by the setting of the threshold circuit 126.

In normal operation, the main supply conduit 119 delivers liquid plasticizer to the conduits 118*a* and 118*b* which, in turn, supply liquid plasticizer to the corresponding groups of pipes 117*a* and 117*b* for the application of liquid plasticizer to the respective sides or surfaces 102*a*, 102*b* of the resonator 102. The resonator 102 oscillates whereby the liquid which is delivered in the region of selected nodes K flows toward the antinodes of the resonator 102 and is converted into minute droplets which are applied to the traveling tow 114.

If the speed of the tow 114 drops below a predetermined value, the threshold circuit 126 transmits a signal which causes the solenoid 123*a* to close the valve 123 so that the admission of liquid plasticizer to the conduit 118*b* and pipes 117*b* is interrupted. This means that the rate of delivery of plasticizer to the resonator 102 is reduced in dependency on the ratio of cross-sectional areas of the conduits 118*a* and 118*b*. The provision of shutoff valve 123 ensures that all of the pipes 117*a* receive equal quantities of liquid plasticizer when the tow 114 is transported at a relatively low speed. This, in turn, ensures uniform application of atomized plasticizer to the respective side of the two 114, namely, to the full width of the tow in the path adjacent to the resonator 102.

FIG. 4 shows (by phantom lines) additional pipes 117*a'* and 117*b'* which receive liquid plasticizer from larger conduits or manifolds 118*a'*, 118*b'*. The conduits 118*a'*, 118*b'* can be provided in addition to the conduits 118*a*, 118*b* of FIG. 3, and the discharge ends of the pipes 117*a'*, 117*b'* are adjacent to those nodes K which are located between the discharge ends of the pipes 117*a*, 117*b* shown in FIG. 3. The conduits 118*a'*, 118*b'* can also contain shutoff valves which open when the speed of the main prime mover of the filter rod making machine rises beyond a given value (higher than the value at which the tachometer generator 124 of FIG. 3 causes the shufoff valve 123 to open) so that the rate of admission of liquid plasticizer to the apparatus 100 can be regulated, with an even higher degree of accuracy, as a function of changes in the speed of the tow 114.

It is further clear that each of the conduits 118*a*, 118*b* or each of the conduits 118*a*, 118*b*, 118*a'*, 118*b'* can receive liquid plasticizer from a discrete pump corresponding to the pump 122 of FIG. 3, and that the number of active or operative pumps can be varied in dependency on the speed of the tow 114. All of the just mentioned pumps can draw liquid plasticizer from a common source, or each pump, or each group of pumps, can be associated with a separate source. If the rate of admission of liquid plasticizer to the atomizing apparatus of FIG. 3 or 4 is to be regulated with an even higher degree of accuracy, each of the pipes 117*a*, 117*b* or each of the pipes 117*a*, 117*b*, 117*a'*, 117*b'* can receive liquid plasticizer from a separator metering pump.

The atomizing apparatus 100 is susceptible of many additional modifications without departing from the spirit of the invention. As mentioned above, the tow 114 can be caused to advance between two atomizing devices 101 to ensure uniform distribution of finely atomized plasticizer at both sides of the filamentary material. Also, the number of pipes 117*a* or 117*b* can be increased above or reduced to less than five. The same holds true for the number of pipes 117*a'* and 117*b'*.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for applying liquid plasticizer to a running tow of filamentary filter material, particularly in a filter rod making machine, comprising a source of liquid plasticizer; means for transporting the tow of filamentary material along a predetermined path having a predetermined width; an ultrasonic atomizing device adjacent to said path and operable to spray atomized plasticizer onto successive increments of the tow in said path, comprising a flexural resonator having a substantially rectangular atomizing surface extending substantially along the full width of said path, piezoceramic means connected with said resonator and a source of a-c potential connected with said piezoceramic means to effect expansion and contraction of said piezoceramic means and corresponding movements of said flexural resonator; and means for supplying plasticizer from said source to said atomizing device, including means for delivering liquid plasticizer to said atomizing device.

2. The apparatus of claim 1, further comprising banding means for spreading the tow in said path so that the tow forms a thin layer of exposed filamentary material during transport past said atomizing device.

3. The apparatus of claim 1, wherein said delivering means comprises means for delivering to said surface of said flexural resonator metered quantities of plasticizer.

4. The apparatus of claim 3, wherein said transporting means comprises means for advancing the tow at a plurality of speeds and said delivering means comprises means for varying the rate of delivery of plasticizer to said surface of said flexural resonator as a function of changes in the speed of movement of the tow along said path.

5. The apparatus of claim 1, wherein said supplying means includes means for delivering plasticizer to said surface substantially along the full width of said path.

6. The apparatus of claim 1, wherein said flexural resonator includes an elongated substantially strip-shaped member having a first side and a second side, said piezoceramic means being disposed at one side of said strip-shaped member.

7. The apparatus of claim 6, wherein said strip-shaped member has a substantially rectangular outline.

8. The apparatus of claim 6, wherein said flexural resonator has a plurality of oscillation nodes spaced apart from each other, as considered in the longitudinal direction of said strip-shaped member, said supplying means including conduit means for delivery of plasticizer to said strip-shaped member in the region of at least some of said nodes.

9. The apparatus of claim 8, wherein said strip-shaped member is disposed substantially vertically and said conduit means includes means for discharging plasticizer against both sides of said strip-shaped member.

10. The apparatus of claim 9, further comprising means for interrupting the delivery of plasticizer to one side of said strip-shaped member.

11. The apparatus of claim 1, wherein said ultrasonic atomizing device is disposed at one side of said path and further comprising a second ultrasonic atomizing device at the other side of said path and means for supplying liquid plasticizer to said second atomizing device.

12. The apparatus of claim 1, wherein said path is substantially horizontal.

13. The apparatus of claim 11, wherein said atomizing devices are staggered with reference to each other, as considered in the longitudinal direction of the tow in said path.

14. The apparatus of claim 1, wherein said plasticizer is triacetin.

* * * * *